US007909263B2

(12) United States Patent
Marshall

(10) Patent No.: US 7,909,263 B2
(45) Date of Patent: Mar. 22, 2011

(54) METHOD OF DISPERSING FINE PARTICLES IN A SPRAY

(75) Inventor: Daniel S. Marshall, Chandler, AZ (US)

(73) Assignee: Cube Technology, Inc., Chandler, AZ (US)

( * ) Notice: Subject to any disclaimer, the term of this patent is extended or adjusted under 35 U.S.C. 154(b) by 498 days.

(21) Appl. No.: 10/886,757

(22) Filed: Jul. 8, 2004

(65) Prior Publication Data

US 2006/0006250 A1 Jan. 12, 2006

(51) Int. Cl.
*A62C 5/02* (2006.01)

(52) U.S. Cl. ..... 239/10; 239/13; 239/128; 239/135; 239/310; 239/419; 427/377; 427/569

(58) Field of Classification Search ..... 239/8, 9, 239/10, 398, 419, 135, 128, 134, 79, 85, 239/310, 13; 427/314, 377, 569
See application file for complete search history.

(56) References Cited

U.S. PATENT DOCUMENTS

| | | | | | |
|---|---|---|---|---|---|
| 4,582,731 | A | | 4/1986 | Smith | |
| 4,734,451 | A | | 3/1988 | Smith | |
| 4,923,720 | A | | 5/1990 | Lee et al. | |
| 4,970,093 | A | * | 11/1990 | Sievers et al. | 427/575 |
| 5,302,414 | A | * | 4/1994 | Alkhimov et al. | 427/192 |
| 5,548,004 | A | * | 8/1996 | Mandel et al. | 523/342 |
| 5,639,441 | A | * | 6/1997 | Sievers et al. | 424/9.3 |
| 5,652,021 | A | | 7/1997 | Hunt et al. | |
| 5,708,039 | A | | 1/1998 | Daly et al. | |
| 5,744,777 | A | | 4/1998 | Bernecki et al. | |
| 5,789,027 | A | * | 8/1998 | Watkins et al. | 427/250 |
| 5,997,956 | A | | 12/1999 | Hunt et al. | |
| 6,095,134 | A | | 8/2000 | Sievers et al. | |
| 6,114,414 | A | * | 9/2000 | Daly et al. | 523/330 |
| 6,240,859 | B1 | | 6/2001 | Jones, Jr. | |
| 6,368,665 | B1 | | 4/2002 | Hunt et al. | |
| 6,433,933 | B1 | | 8/2002 | Gettemy | |
| 6,500,350 | B1 | | 12/2002 | Hunt et al. | |
| 6,502,767 | B2 | * | 1/2003 | Kay et al. | 239/433 |
| 6,589,312 | B1 | | 7/2003 | Snow et al. | |
| 6,660,176 | B2 | | 12/2003 | Tepper et al. | |
| 6,716,891 | B1 | | 4/2004 | Meisenburg et al. | |
| 6,727,316 | B1 | | 4/2004 | Bremser | |
| 6,728,092 | B2 | | 4/2004 | Hunt et al. | |
| 6,734,379 | B1 | | 5/2004 | Savadian et al. | |
| 6,736,996 | B1 | | 5/2004 | Carbonell et al. | |
| 6,737,468 | B1 | | 5/2004 | Bremser | |
| 6,749,902 | B2 | * | 6/2004 | Yonker et al. | 427/458 |
| 6,821,429 | B2 | * | 11/2004 | Perrut | 210/634 |
| 2001/0039919 | A1 | | 11/2001 | Hunt et al. | |
| 2002/0015797 | A1 | | 2/2002 | Hunt et al. | |
| 2003/0047617 | A1 | | 3/2003 | Shanmugham et al. | |
| 2003/0222017 | A1 | | 12/2003 | Fulton et al. | |
| 2003/0222018 | A1 | | 12/2003 | Yonker et al. | |
| 2003/0222019 | A1 | | 12/2003 | Fulton et al. | |
| 2004/0011245 | A1 | | 1/2004 | Sambasivan et al. | |
| 2004/0043140 | A1 | | 3/2004 | Jagannathan et al. | |

* cited by examiner

*Primary Examiner* — Steven J Ganey
(74) *Attorney, Agent, or Firm* — Parsons & Goltry; Robert A. Parsons; Michael W. Goltry

(57) ABSTRACT

A method of dispersing fine particles in a spray including the steps of providing a liquid carrier having a critical point and fine particles of at least one material. The fine particles are dispersed in the liquid carrier. A supercritical carrier containing dispersed particles is created by driving the liquid carrier containing dispersed fine particles above the critical point. The pressure of the supercritical carrier containing dispersed particles is reduced thereby forming a vapor carrier containing dispersed particles therein. The vapor carrier containing dispersed fine particles is then discharged.

7 Claims, 2 Drawing Sheets

METHOD OF DISPERSING FINE PARTICLES IN A SPRAY

FIELD OF THE INVENTION

This invention relates to particle dispersion.

More particularly, the present invention relates to particle dispersion in a spray application.

BACKGROUND OF THE INVENTION

Dispersion of fine particles for various applications, such as plasma spray deposition, combustion, and the like, has been successfully accomplished for particles of relatively large size. Once a minimum particle size is reached, such as less than ten microns, particle attraction forces overcome gravitational forces resulting in clumping and cohesion of the particles. When this occurs, dispersion of these very fine particles is difficult to achieve.

A specific area of interest is the use of particles in plasma sprays. Currently, plasma sprays are employed for material deposition, formation and alloying. RF plasma spray devices inject powders formed of fine particles into plasma created by RF induction coils. The particles in the powder can be softened or even completely melted. The particles are then deposited from the plasma onto a substrate or cooled, allowing surface tension to create spheres of the material which are then collected. While very useful for relatively large particles, such as particles greater than 10 microns, smaller Nano sized particles do not work well in RF plasma spray devices. Specifically, as the particle size decreases, such as less than ten microns, inter-particle forces are equal or greater than gravity, resulting in clumping of the powders. Recently, plasma devices have been made which permit very fine particles to be efficiently injected into plasma for deposition. These devices are employed in what is called suspension plasma spray.

Suspension plasma spray devices utilize particles suspended in a liquid carrier. The suspension is brought into the plasma discharge as a stream of fine droplets by an atomizing probe. Very fine particles are easily handled with the suspension. When the suspension is introduced into the plasma discharge, the carrier substance is vaporized with the particles agglomerating into partially or totally melted drops. These drops are then deposited or collected as desired. While effective, the droplets contain multiple particles which agglomerate with vaporization of the carrier. Thus, the resulting agglomerated material includes multiple particles, the agglomeration having a much greater size than the individual particles. Additionally, this method is used as a means of alloying materials. When particles of different materials are employed, the partial or complete melting of the agglomerated materials results in partially or completely alloyed material.

It would be highly advantageous, therefore, to remedy the foregoing and other deficiencies inherent in the prior art.

Accordingly, it is an object the present invention to provide a new and improved method of dispersing fine particles in a spray.

Another object of the present invention is to provide a method of dispersing very fine particles in a gaseous spray.

Yet another object of the present invention is to provide a method of simultaneously depositing very fine particles of different materials.

SUMMARY OF THE INVENTION

Briefly, to achieve the desired objects of the present invention in accordance with a preferred embodiment thereof, provided is a method of dispersing particles in a spray. The method includes providing a liquid carrier having a critical point and particles of a material. The particles are dispersed in the liquid carrier. A supercritical carrier containing dispersed particles is created by driving the liquid carrier containing dispersed particles above the critical point. The supercritical carrier containing dispersed particles is then discharged.

In a specific aspect of the present invention, discharging the supercritical carrier includes decreasing the pressure of the supercritical carrier containing dispersed particles to form a vapor carrier containing dispersed particles. Additionally, the temperature of the supercritical carrier can be decreased if desired, to form a proportion of liquid carrier with the vapor carrier containing dispersed particles therein. It is desirable that the proportion of liquid carrier to vapor carrier not exceed 1:1.

In another aspect of the present invention, a method of plasma spraying fine particles is provided. In this method, a plasma discharge is provided. A supercritical carrier containing dispersed particles is injected into the plasma discharge. In a particular aspect, the supercritical carrier containing particles includes particles of at least two different materials. Also, injecting the supercritical suspension of particles includes mixing particles with a liquid carrier and applying heat and pressure to at least a critical point of the liquid carrier. The step of injecting can further include decreasing the pressure of the supercritical carrier containing dispersed particles, thereby forming a vapor carrier containing dispersed particles therein.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

A dispersion of fine particles in a spray has many potential applications. These applications include deposition of materials, combustion processes for energy conversion and the like. In this description, fine particles refer to particles of material which have reached a minimum size in which particle attractive forces are stronger than the force of gravity or other forces which tend to separate particles. In other words, the particles are of such a small size as to tend to clump, cake or otherwise adhere to one another. This is typically seen in particles less than 5 microns in size.

As an example of the inability to properly disperse particles, gasses have much fewer molecules in a volume than do liquids. The relatively widely spaced molecules are insufficient to separate very small particles and prevent cohesion there between. Therefore, the particles are inadequately dispersed (form clumps) in a vapor carrier. Liquids have a much denser concentration of molecules and therefore liquid carriers more efficiently separate particles, dispersing them throughout and preventing clumping due to the relatively large number of particles separating each particle. Unfortunately, for the present purposes, liquids also have surface tension which results in droplets containing multiple particles when sprayed. Evaporation of the liquid carrier will result in agglomerations of particles. Thus, each carrier substance, vapor and liquid, has its limitations, preventing fine particles being properly dispersed in a spray.

Figure 1:
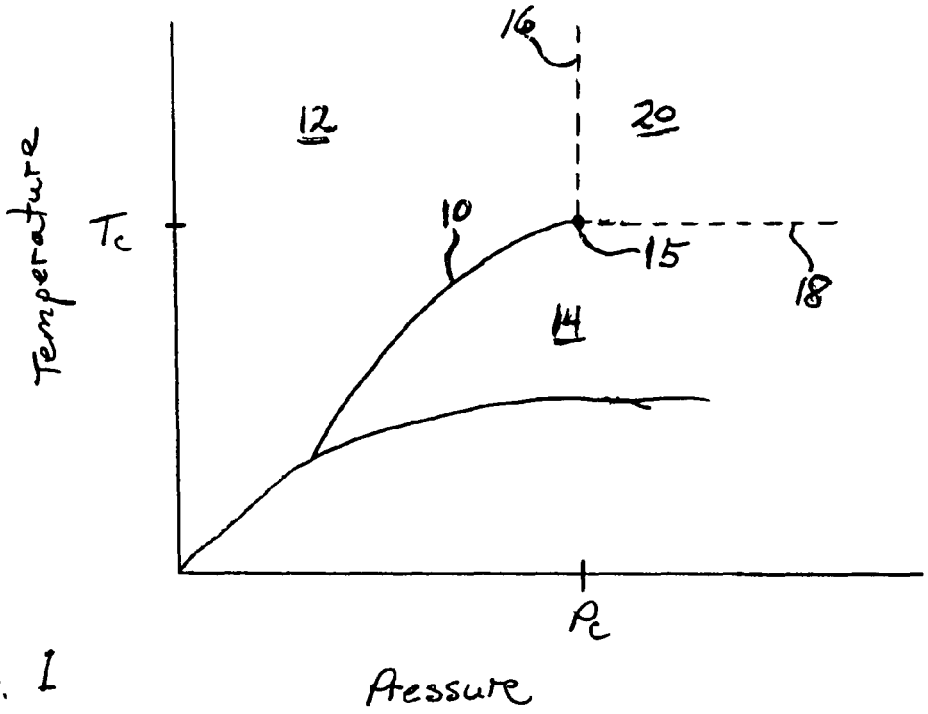
FIG. 1 is a phase diagram.

Turning Now to FIG. 1, a phase diagram is illustrated. A phase diagram illustrates the conditions for solid, liquid and gaseous phases of a substance while undergoing pressure and temperature changes. While phase diagrams vary depending upon the substance diagrammed, for purposes of illustration, FIG. 1 shows a typical phase diagram of a one-component system. In the present invention vapor/liquid line 10 is of primary interest. Line 10 is the boundary, defined by temperature and pressure, at which only vapor can exist on the low-pressure, high-temperature side, vapor zone 12, while the substance is liquid on the high-pressure, low temperature side liquid zone 14. Liquid and vapor exist together at temperatures and pressures corresponding to points on line 10. At a specific temperature and pressure, depending on the substance, line 10 disappears at a point called the critical point 15. At temperatures and/or pressures greater than or equal to critical point 15, as indicated by broken lines 16 and 18, a supercritical zone 20 is defined. Line 16 defines the boundary between supercritical zone 20 and vapor zone 12. Line 18 defines the boundary between supercritical zone 20 and liquid zone 14. In supercritical zone 20, the boundary between liquid and vapor disappears with the liquid and vapor becoming indistinguishable. At temperatures and pressures above critical point 15, the supercritical substance is much denser than a vapor, but does not have surface tension like a liquid. These characteristics both contribute to the ability to distribute particles therein, while preventing formation of droplets which will become agglomerate upon evaporation of the carrier.

Figure 2:
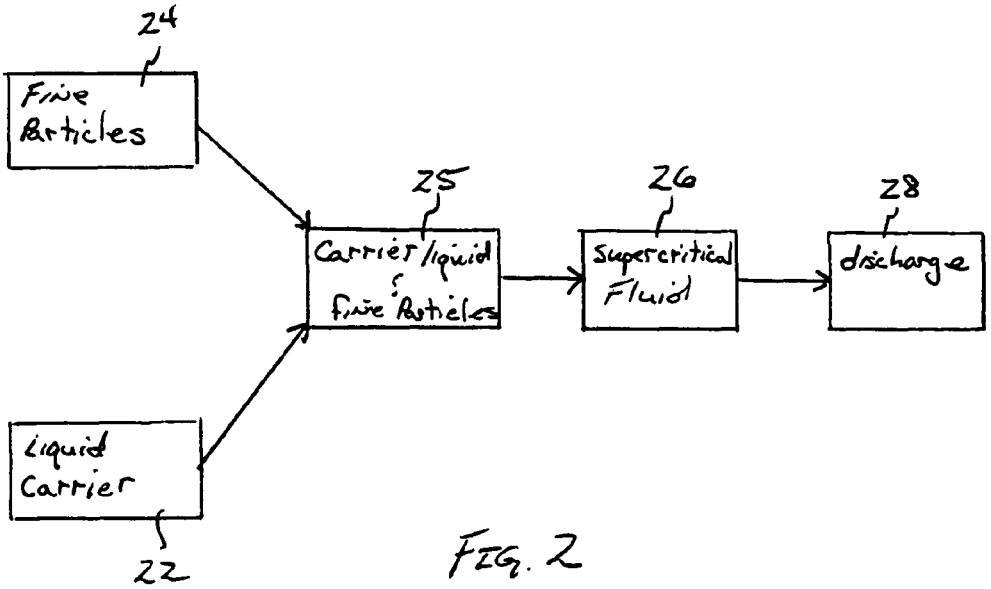
FIG. 2 is a is a simplified block diagram of the method according to the present invention.

Turning Now to FIG. 2, the method of the present invention includes providing a liquid carrier 22 and a plurality of one or more types of fine particles 24. Particles 24 of one or more materials are dispersed in liquid carrier 22. The result is a liquid carrier 25 containing the particles dispersed throughout. The liquid carrier with dispersed particles 25 is then driven by heat and pressure above the critical point of liquid carrier 22 to produce a supercritical carrier 26 containing the dispersed particles. Supercritical carrier 26 containing the dispersed particles is discharged at 28 for a desired application. With Additional Reference Back to FIG. 1, upon discharge, supercritical carrier 26 may undergo a drop in pressure and temperature to a point below critical point 12. Proper positioning of supercritical carrier 26 within supercritical zone 20 will result in supercritical carrier 26 crossing line 16 into vapor zone 12 in a no mist condition. In effect, no liquid is formed, only vapor. As can be seen with reference to figure one, the position at which supercritical carrier 26 crosses line 16 determines the proportion of vapor and liquid in the resulting carrier.

Figure 3:
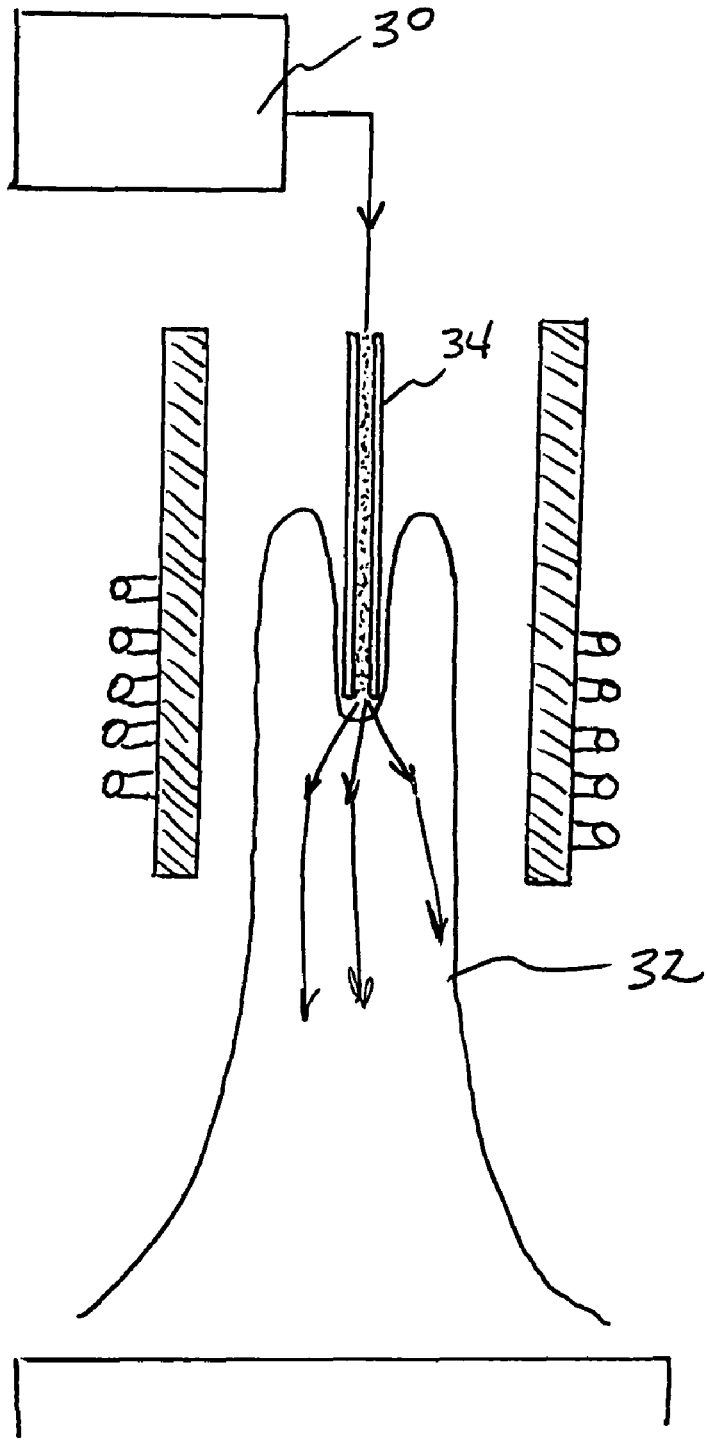
FIG. 3 is a simplified schematic of an embodiment utilizing plasma spray, according to the present invention.

Turning now to FIG. 3, with additional reference to FIG. 1, in a specific embodiment using a RF plasma spray device, a supercritical carrier 30 containing fine particles is injected into a plasma discharge 32. Upon discharge of supercritical carrier through a nozzle 34, the supercritical carrier undergoes a reduction in pressure, also reducing temperature, resulting in the supercritical carrier falling below the critical point and becoming either vapor or liquid. It is desirable to minimize the formation of the liquid carrier which can then form droplets, by assuring the formation of a vapor carrier instead. Thus, by adjusting or maintaining the temperature of the supercritical carrier as it passes out of the supercritical zone, greater amounts of vapor carrying the particles can be formed. The point the supercritical carrier is within zone 20 can affect the proportions of fluid carrier and vapor carrier produced. At higher temperatures and lower pressures within supercritical zone 20, dropping of pressure has a tendency to result in this supercritical carrier crossing line 16 to produce a vapor. While one hundred percent vapor carrier containing the particles is desirable, small amounts or even larger amounts of the liquid carrier containing the particles can also be produced, as desired. For example, at critical point 15, a relatively equivalent proportion of gas carrier and liquid carrier containing the particles are produced.

Thus, supercritical carrier 30 is adjusted with a temperature and pressure appropriate to cross line 16 from supercritical zone 20 into vapor zone 12. Variations in the proportion of vapor carrier and liquid carrier can be achieved as desired, with adjustments to the position of the supercritical carrier within supercritical zone 20. As the vapor carrier carrying the particles is injected into plasma discharge 32 through nozzle 34, the vapor carrier evaporates leaving a dispersion of fine particles within plasma discharge 32. Since a vapor carrier and not a liquid carrier is employed, droplets are avoided reducing or eliminating agglomeration of the particles. When the vapor evaporates, the fine particles are dispersed throughout plasma discharge 32, preventing clumping or agglomeration. In this manner, particles of different materials will not form alloys within the plasma. Instead, each individual particle will soften or liquify as desired and can be used in a selected application. A specific application, by way of example, is the deposition of particles of different material on a substrate to form of a mosaic structure. Formation of the structure has been disclosed in pending U.S. patent application Ser. No. 10/836,465, entitled THERMOELECTRIC MATERIAL STRUCTURE AND METHOD OF FABRICATION, filed 30 Apr. 2004, herein incorporated by reference.

While fine particles of many different materials may be employed, the particles are generally selected from groups consisting of insulators, semi-conductors, conductors, and hopping conductors. Additionally, while an RF plasma spray is employed in the preferred embodiment, it will be understood that other plasma devices can be employed. Also, plasma is intended to include flame spray applications.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A method of dispersing fine particles in a spray, comprising the steps of:

providing a liquid carrier having a critical point;

providing fine particles of at least one material;

dispersing the fine particles in the liquid carrier;

creating a supercritical carrier containing dispersed particles by driving the liquid carrier containing dispersed fine particles above the critical point;

decreasing the pressure of the supercritical carrier containing dispersed particles, thereby forming a vapor carrier containing dispersed particles therein; and discharging the vapor carrier containing dispersed fine particles.

2. A method is claimed in claim 1 wherein the step of decreasing the pressure of the supercritical carrier further includes decreasing the temperature of the supercritical carrier to form a proportion of liquid carrier containing dispersed particles therein with the vapor carrier containing dispersed particles therein.

3. A method as claimed in claim 2 wherein the proportion of liquid carrier to vapor carrier does not exceed 1:1.

4. A method as claimed in claim 1 wherein the step of creating a supercritical carrier containing dispersed particles includes applying heat and pressure to the liquid carrier containing dispersed particles.

5. A method as claimed in claim 1 wherein the step of providing particles of at least one material includes providing particles less than 5 microns.

6. A method as claimed in claim 1 wherein the step of discharging the vapor carrier containing dispersed particles includes injecting the vapor carrier containing dispersed particles into a plasma discharge.

7. A method as claimed in claim 1 wherein the step of providing particles of material include selecting the particles of material from a group including insulators, semi-conductors, conductors, and hopping conductors.

* * * * *